United States Patent [19]

Khattak et al.

[11] Patent Number: 4,963,096

[45] Date of Patent: Oct. 16, 1990

[54] DEVICE AND METHOD FOR IMPROVING SHOOTING SKILLS

[76] Inventors: Anwar S. Khattak, 612 S. Lincoln St., Spokane, Wash. 99204; Masao Shimoji, E. 3012 Nora Rear Apt., Spokane, Wash. 99207

[21] Appl. No.: 343,199

[22] Filed: Apr. 26, 1989

[51] Int. Cl.[5] ..... F41G 3/00; F41G 11/00

[52] U.S. Cl. ..... 434/21; 434/19; 273/312; 273/315

[58] Field of Search ..... 434/19–22; 273/310–315

[56] References Cited

U.S. PATENT DOCUMENTS

| | | | |
|---|---|---|---|
| 2,023,497 | 12/1935 | Trammell | 434/21 X |
| 3,240,924 | 3/1966 | Darby | 273/310 X |
| 3,788,733 | 1/1974 | Breglia et al. | 434/21 X |
| 3,904,204 | 9/1975 | Yokoi | 434/22 X |
| 4,349,337 | 9/1982 | Pardes | 273/310 X |
| 4,592,554 | 6/1986 | Gilbertson | 434/22 X |
| 4,811,955 | 3/1989 | DeBernardini | 434/21 X |

*Primary Examiner*—Richard J. Apley
*Assistant Examiner*—J. L. Doyle
*Attorney, Agent, or Firm*—Armstrong, Nikaido, Marmelstein, Nikaido & Murray

[57] ABSTRACT

A device and method for improving and refining a shooter's skills has a laser or light beam, when the device is turned on, emitted from a laser diode or a light emitting diode to a collimating lens and through a hollow shaft, and to a prism being rotated by a shaft and motor. The beam is deflected in different directions so that a rapid rotation of the prism permits the beam to form a substantially circular reflecting image. The diameter of the image can be adjusted by adjusting an adjustable lens. When a shooter aims at a clay target, the shooter moves the gun barrel at a sweeping line of sight along a target flight path until the moving target intersects a point on the circumference of the substantially circular image for indicating to the shooter that a proper lead has been achieved for successfully shooting the moving target. Moreover, a receiver can be mounted on the housing for allowing an instructor to evaluate how well the shooter is performing. The receiver has a housing and a lens at one end thereof. Preferably within the intermediate portion of the receiver housing is a detector. The receiver further has a flasher which is triggered by a reflecting light caused by the moving target intersecting a point on the circumference of the image for providing the proper lead. The flashing of the receiver is readily observable by the instructor for indicating to the instructor whether the shooter has properly reacted to the moving target intersecting the reflected image.

12 Claims, 2 Drawing Sheets

DEVICE AND METHOD FOR IMPROVING SHOOTING SKILLS

BACKGROUND OF THE INVENTION

This invention relates generally to a device and method for improving or refining shooting skills. More particularly, this invention relates to a device which can be attached or mounted to a shotgun barrel for improving or refining a person's skills in the sport of skeet or trap shooting.

Often, many persons in the sport of skeet or trap shooting become frustrated due to the difficulty in shooting the clay target. This frustration is aggravated when the clay target is consistently missed and becomes more illusive in spite of an instructor's numerous teachings that a proper lead or an accurate distance between the barrel and the moving clay target be established. In other words, in order to have a shot jettisoned from the shotgun to consistently intercept a moving clay target, there must be an accurate or proper lead established between the shotgun barrel and the moving clay target.

The importance of establishing an accurate or proper lead between the shotgun barrel and the moving clay target becomes more critical when shooting from certain areas of the shooting range; i.e., when shooting from relatively more difficult stations. In other words, although a person may have developed a relatively good shooting skill in certain stations, the frustration remains when he cannot maintain an accurate or proper lead in shooting the moving clay target at relatively more difficult stations.

Accordingly, there is a need for a device to improve or refine a person's skeet or trap shooting skills which may be easily attached or mounted on a shotgun barrel. Such a device should have sufficient rigidity and durability in order to withstand the recoil and the consistent swinging of the barrel when in use. Moreover, the device should be made out of lightweight materials so that it may be easily attached or mounted on a shotgun barrel and removed when necessary. Similarly, it is highly desirable that the device of this invention be relatively sized so as not to distract the view of a shooter when in use. Furthermore, the device may have a part which enables an instructor to fully evaluate the improvement of the shooter.

SUMMARY OF THE INVENTION

It is an object of this invention to provide a device for improving or refining a person's shooting skills.

It is still another object of this invention to provide a device for improving or refining a person's skeet or trap shooting skills.

It is still another object of this invention to provide a training or refining device for skeet or trap shooting which can be attached or mounted on a shotgun barrel.

It is yet another object of this invention to provide a training or refining device for skeet or trap shooting which can provide a reference guide for establishing an accurate or proper lead to enable a shooter to consistently shoot the moving clay.

It is a further object of this invention to provide a training or refining device for skeet or trap shooting which can provide a reference guide for establishing an accurate or proper lead to enable a shooter to refine his shooting skills, especially in relatively more difficult stations in a shooting range.

It is a further object of this invention to provide a training or refining device for skeet or trap shooting which can provide a reference guide for establishing an accurate or proper lead to enable a shooter to improve or refine his shooting skills by providing a signal to the shooter as to when to fire the shotgun for a consistently successful shooting of a moving clay target.

It is a further object of this invention to accomplish the above by a training or refining device for skeet or trap shooting having sufficient rigidity and durability in order to withstand the recoil and the consistent swinging of the barrel when in use.

It is a further object of this invention to accomplish the above by a training or refining device for skeet or trap shooting device which is made out of lightweight materials so that it may be easily attached or mounted on a shotgun barrel and removed when necessary.

It is a further object of this invention to accomplish the above by a training or refining device for skeet or trap shooting device which is relatively sized so as not to distract the view of a shooter when in use.

It is a further object of this invention to provide a training or refining device for skeet or trap shooting which may have a part which enables an instructor to fully evaluate the improvement of the shooter.

In accordance with an embodiment of this invention, a device for training or refining the skeet or trap shooting skills of a shooter has a housing with a base portion and a power source at one end thereof. Within the housing and preferably mounted on the base portion is a light emitting diode for emitting a laser beam to a collimating lens. Both the light emitting diode and collimating lens are preferably housed or mounted on the housing. In the intermediate portion within the housing is a motor having a hollow shaft with a prism at one end of the hollow shaft. A preferably adjustable lens is operably coupled to another end of the housing.

When the device is turned on, a laser beam is emitted from the light emitting diode to the collimating lens and through the hollow shaft, and to the prism being rotated by the shaft and motor. The beam is deflected in continuously different directions so that a rapid rotation of the prism permits the beam to form a substantially circular reflecting image when intercepted in free space. The diameter of the image can be adjusted by adjusting the adjustable lens. When a shooter aims at a clay target, the shooter moves the gun barrel along a sweeping line of sight until the moving target intersects a point on the circumference of the substantially circular image which, in turn, indicates that a proper lead has been achieved for successfully shooting the moving target.

Moreover, a receiver may be mounted on the housing for allowing an instructor to evaluate how well the shooter is performing. The receiver has a housing, a lens and a filter at one end thereof. Preferably within the intermediate portion of the receiver housing is a detector. The receiver further has a flasher which is triggered by a reflecting light caused by the moving target in intersecting a point on the circumference of the image for providing the proper lead. The flashing of the receiver is readily observable by the instructor for indicating to the instructor whether the shooter has properly reacted to the moving target's intersecting the reflected image.

The foregoing and other objects, features and advantages of this invention will be apparent from the following, more particular, description of the preferred embodiments of this invention, as illustrated in the accompanying drawings.

DESCRIPTION OF THE PREFERRED EMBODIMENTS

Figure 1:
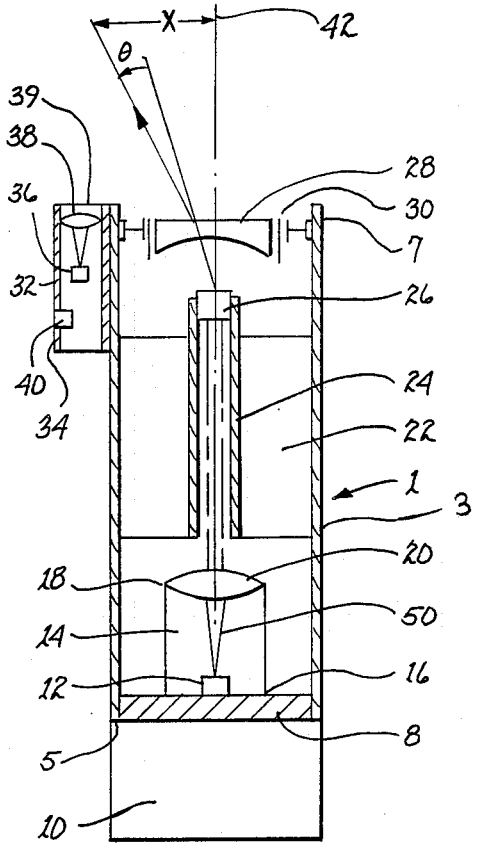
FIG. 1 is a partial cross-sectional view of the device for improving or refining a person's skeet or trap shooting skills of this invention.

FIG. 1 a partial cross-sectional view of the device for improving or refining a person's skeet or trap shooting skills of this invention, generally referred to hereinafter as "training device", and generally designated by reference number 1. The training device 1 has a housing 3 which can be an elongated tubular member or the like, although not limited thereto. The housing 3 has a first end 5 and a second end 7. At the first end 5 is a base portion 8 preferably coupled and fitted at the inner surface thereof. A power supply 10 is mounted at the base portion 8 for supplying power to the training device 1. The power supply 10 may be a dry battery pack 10, or the like.

Mounted within the housing 3 and on the base portion 8 is a light emitting diode (LED), laser diode or the like 12. The light emitting diode 12 may be a laser diode, or the like. The light emitting diode 12 is housed within an inner housing 14 which is preferably a cylinder, or the like. The inner housing 14 has one end 16 mounted on the base portion 8, and a free-standing end 18. The free-standing end 18 of the inner housing 14 can accommodate and fit within it a collimating lens 20, although the collimating lens 20 may be mounted on the free-standing end 18.

Within the intermediate portion of the housing 3 is a motor 22, preferably an electric motor, which has a rotatable and preferably hollow shaft 24 operably coupled thereto. At one end of the shaft 24 is a prism 26 which can either be mounted within or mounted on the end of the shaft 24.

The second end 7 of the housing 3 is a lens member 28 which is preferably mounted within or on the second end 7. The lens member 28 preferably has an adjusting device 30 for allowing the lens member 28 to be adjusted, either mechanically or electrically. The lens member 28 can be adjusted relative to the axis 42 of the housing 3, prism 26, or the like, so that the angle 0 of beam deflection may be varied. The focal length of the lens member 28 determines the degree of beam divergence. The lens member 28 may be a part of a lens system (not shown) having a focal length which is adjustable and which in turn determines the degree of beam divergence.

The device 2 of this invention can also include a receiving unit 32 which is preferably electronic. The receiving unit 32 has a housing 34 which may be cylindrical or the like and may be removably coupled to the housing 3. Within the housing 34 is a photo-detector 36 coupled thereto, while a focusing lens 38 is mounted within or on one end of the receiving unit housing 34. Also at the end of the housing 34 is a filter 39 preferably proximate the focusing lens 38 and is preferably a substantially narrow band interference filter type lens. Also coupled to the housing 34 is a light emitting diode (LED) 40 preferably visible outside the housing 34 at least when in operation. Preferably within the housing 34 is a conventional signal processing circuit (not shown) which processes an electrical signal from the photodetector 36 in order to flash the LED 40.

Figure 3:
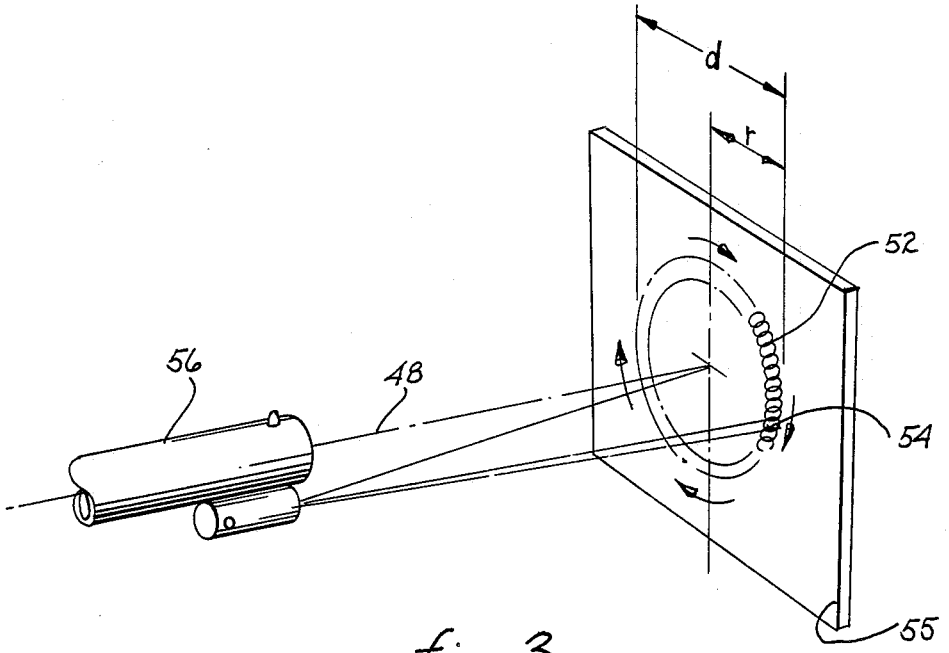
FIG. 3 is a schematic view of the reference guide provided by the device of this invention for establishing an accurate or proper lead in skeet or trap shooting.

The device 1 preferably has an axis 42 which is preferably aligned with the axis 48 of the shotgun barrel 56 (see, FIG. 3). Also, it is preferred, although not limited thereto, that the device 1 be attached below the shotgun barrel 56.

Figure 2:
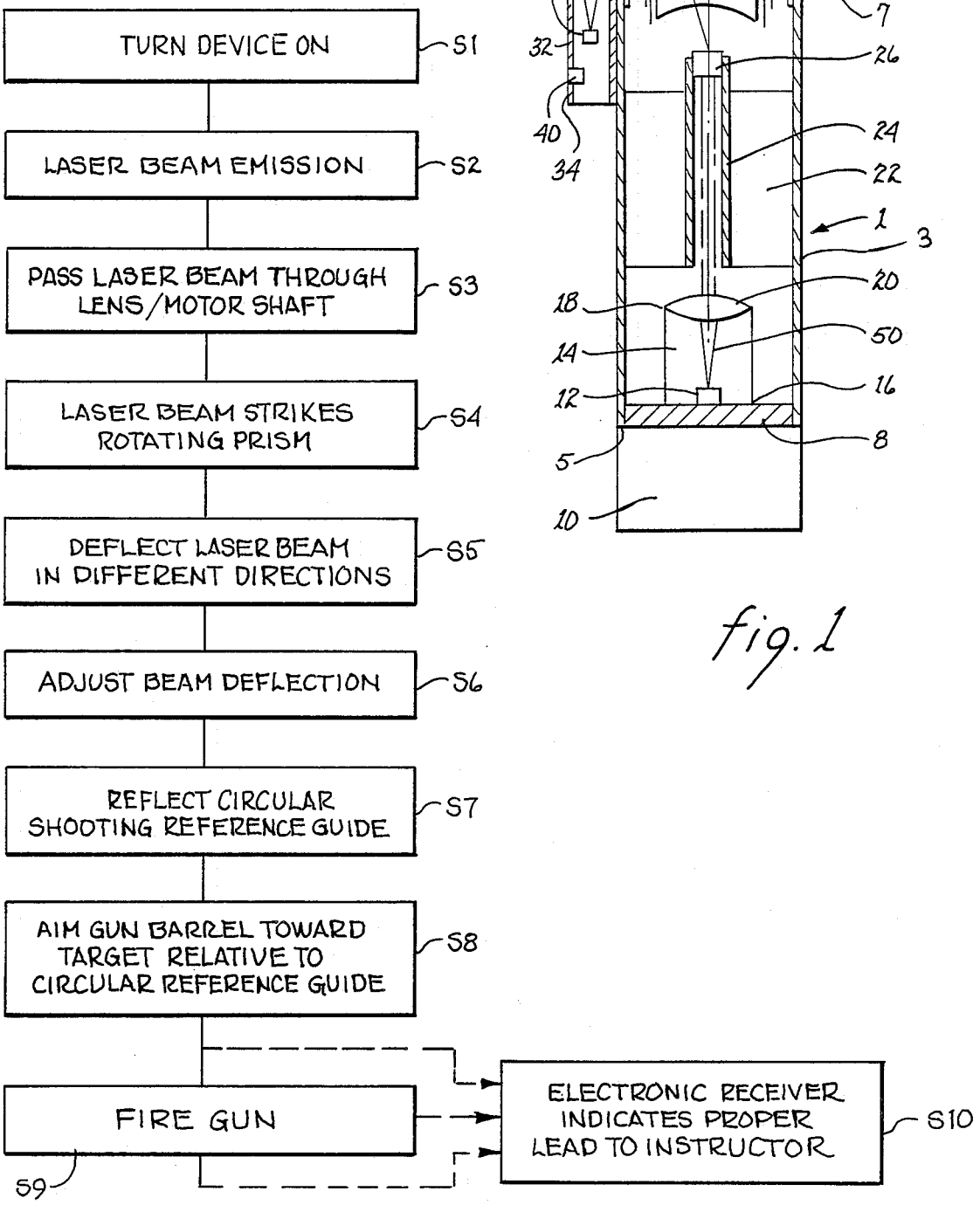
FIG. 2 is flow diagram including the method steps for improving or refining a person's skeet or trap shooting skills of this invention.

The operation of the device 1 is hereinafter described as illustrated in FIGS. 1 through 3. When a switch (not shown) is turned on (S1), the light emitting diode, laser diode, or the like 12 which is operably connected to the power supply 10 emits a light beam or a laser beam 50 (S2). The laser beam 50 passes through the collimating lens 20, and through the shaft 24 (S3). The laser beam 50 also passes through the longitudinal opening of the shaft 24 which is rotated by the motor 22 when the switch (not shown) turning on the laser diode 12 is turned on. It is noted however that two switches (not shown) may be provided for separately operating the laser diode 12 and the motor 22. After the laser beam 50 passes through the shaft 24, the beam 50 strikes the prism 26 (S4) which rotates along with the shaft 24. The prism 26 thereafter deflects the beam 50 in rapid successions and in different directions (S5) to thereby create a substantially circular image 52.

As shown in FIG. 3, the circular image 52 which when reflected on a screen is essentially a rotating laser spot 54 provided by the laser beam 50 being deflected by the rotating prism 26. The rotation (i.e., rpm) of the motor 22 can be set so that the laser spot 54 rapidly rotates on the screen 55 so as to provide an image 52 which is substantially circular. The lens member 28 can be longitudinally adjusted (S6) (i.e., moved in a longitudinal direction along the length or axis of the housing 3) in order to control the angle $\Theta$ of beam deflection, and the lateral displacement x of the laser beam 50 with respect to the longitudinal axis 42 of the device 1. When the desired diameter d of the circular image 52 has been achieved as a result of the lens member 28 adjustment, the substantially circular image 52 can then be used as a shooting reference guide (S7) which is hereinafter described.

As further illustrated in FIG. 3, once the desired diameter d of the substantially circular image 52 has been set, the radius r of the substantially circular image 52 represents the correct and required lead when the shotgun is aimed and fired toward the center of the substantially circular image which should result in a consistent and successful hitting of the moving clay target.

As illustrated in FIG. 3, when a shooter stands on, for example, Station No. 4 in a shooting range waiting for the clay target to be ejected from, for example, a low house 58, from right to left the shooter aims the gun barrel 56 towards a predicted line of path for the clay target 60. The center of the substantially circular image 52 represents the point of intersection of the shotgun line of sight 48. Once the clay target 60 is ejected from the low house 58, the shooter aims the gun barrel 56

(S8) at the clay target 60 in a sweeping line of sight 62, from right to left, following the path of the clay target, passing the clay target 60, until the clay target 60 intersects point A substantially located on the right side circumference of the substantially circular image 52. Once the moving clay target 60 intersect point A on the substantially circular image 52, the correct gun lead r has been achieved which is indicated by a flash signal from the target to the shooter for the shooter to fire the shots (S9).

The clay target 60 can be provided with a built-in reflector so that when the clay target 60 intersects point A on the image 52, an instantaneous illumination is provided for signalling the shooter to fire the shotgun. Since the device 1 has been provided for purposes of improving or refining a person's shooting skills in the sport of skeet or trap shooting, the human eye is preferred as a natural receiver of light which is reflected from the target 60. In this manner, the hobbyist can enjoy the sport to its fullest while preserving the natural sport of skeet or trap shooting.

In another embodiment of this invention, a receiving unit 32 can be attached to the device 1 as illustrated in FIG. 1. Here, a reflected light is created from the image 52 by the target having a built-in reflector 60 passing through point A of the image 52. The reflected light is received by the photo-detector 36. By means of a conventional signal processing circuit (not shown) within the receiving unit 32, the photo-detector 36 upon receiving the reflected light outputs a signal which can be processed to the light emitting diode 40. The light emitting diode is preferably positioned at a location in the receiving unit 32 so as to readily permit a skeet or trap shooting instructor to observe the instantaneous flashing of the light emitting diode 40. The flashing of the light emitting diode 40 observed by the instructor indicates when the firing of the gun should occur. In other words, the instructor, by observing the flashing of the light emitting diode 40, is able to detect whether the shooter has properly reacted to the image 52 being used as a target reference guide and whether the shooter has fired at the proper time.

Figure 4:
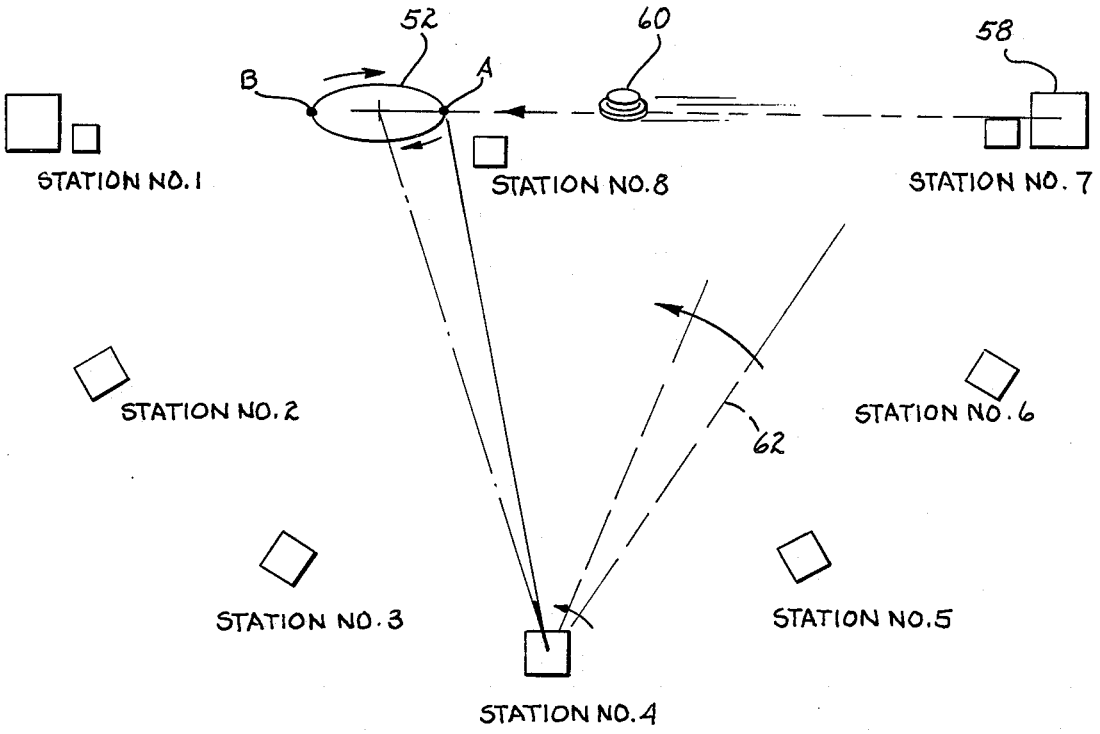
FIG. 4 is a schematic view of a shooting range along with an illustration of the reference guide provided by the device of this invention relative to a moving clay target.

Skeet shooting requires the shooter to swing the shotgun barrel from behind the moving target, pass it and fire when an accurate or proper lead is achieved which must all be accomplished in a single, smooth and swift swinging motion of the gun barrel. If the just-described steps are followed during skeet shooting, the shooter observes two illuminations from the target. The first illumination occurs at a point B preferably directly opposite point A in the image 52, as illustrated in FIG. 4, which serves as a warning signal to the shooter to get ready, while the second illumination which occurs at point confirms the appropriate shotgun lead with respect to the target at which time, the shooter fires the shotgun. If the shooter can maintain the correct lead r (see, FIG. 3) while swinging the shotgun ahead of the target in a smooth motion, the target will remain illuminated as long as the correct lead is held. Therefore, the more accomplished the shooter becomes, the longer he can keep the target and the light emitting diode 40 in the receiving unit 32 illuminated.

Ideally, the plane generated by the sweeping shotgun barrel 56 should also pass through the moving target 60 during skeet shooting. A shooter who is aiming low and out of this ideal plane sees the illuminated target above the gun barrel 56, while the shooter who is aiming above and out of this plane observes the illuminated target below the gun barrel 56. A vertical offset distance between the illuminated target 60 and the gun barrel indicates an out-of-plane target.

Additionally, shooting glasses having a proper interference filter may be used to allow the reflected signal from the target 60 to pass through for better detection of the signal on a bright sunny day. A pair of such spectacles will serve two purposes: (a) providing protection against sun just like regular sunglasses, and (b) enhancing target illumination for easier visibility.

Although commercially available and currently used skeet targets are made from baked clay designed to disintegrate on impact, the same skeet targets may be coated with light reflecting material, i.e. retro-reflective characteristics, in order to have the targets illuminate when intercepting the laser beam.

While the invention has been particularly shown and described in reference to preferred embodiments thereof, it will be understood by those skilled in the art that changes in form and details may be made therein without departing from the spirit and scope of the invention.

We claim:

1. A device for improving shooting skills, comprising:

a housing means for enclosing said device, said housing means has a base means;

a power source means operably connected to said housing means for supplying power to said device;

a means mounted on said base means for emitting at least one of a laser beam and a light beam;

a first lens means mounted on said base means for passing and reflecting at least one of said laser beam and said light beam;

a second lens means for deflecting at least one of said laser beam and said light beam; and a motor means for mounting and continuously rotating said second lens means so as to form a reflecting target image to be aimed at by a shooter.

2. The device as in claim 1, further comprising a third lens means for adjusting the size of said reflecting target image.

3. The device as in claim 2, further comprising an inner housing means for housing said emitting means and for mounting said first lens means.

4. The device as in claim 3, further comprising a receiving means which comprises:

a focusing lens means mounted at one end of said receiving means for focusing and reflecting at least one of a beam and light received from said reflecting target image;

a photo-detecting means mounted within said receiving means for detecting said at least one of said reflecting beam and said reflecting light received from said reflecting target image;

an indicating means operably coupled to said photo-detecting means for indicating to a shooting instructor on whether said shooter has properly reacted to a signal provided by said reflecting target image;

a processing means for triggering said indicating means when said reflecting light is received by said photo-detecting means; and a housing means for housing said focusing means, said photo-detecting means, said indicating means, and said processing means.

5. The device as in claim 1, wherein said emitting means is a means for emitting a laser beam.

6. The device as in claim 1, wherein said emitting means is a means for emitting a light beam.

7. A method for improving shooting skills, comprising the steps:

emitting at least one of a laser beam and a light beam;

passing said at least one of said laser beam and said laser light beam through a lens;

rotating a prism;

passing said at least one of said laser beam and said light beam through said prism;

deflecting said at least one of said laser beam and said light beam in different directions;

reflecting a substantially circular shooting reference guide;

aiming a shotgun barrel toward said substantially circular shooting reference guide;

reflecting an illumination from a moving target; and firing said shotgun barrel in response to said reflection of said illumination.

8. The method as in claim 7, further comprising the steps of attaching a reflection receiving unit to said shotgun barrel.

9. The method as in claim 7, wherein said step of rotating said prism comprises the step of rotating a motor having a shaft operably coupled to said prism.

10. The method as in claim 9, wherein said step of passing said beam through said prism comprises the step of passing said beam through said shaft.

11. The method as in claim 7, wherein said step of aiming said shotgun barrel comprises the step of sweeping said shotgun barrel along a target flight path.

12. The method as in claim 11, wherein said step of aiming said shotgun barrel further comprises the steps of:

allowing said moving target to pass through a first intersecting point in said reference guide as a warning for said shooter to prepare to shoot; and allowing said moving target to pass through a second intersecting point in said reference guide as a signal for said shooter to shoot said shotgun barrel.

* * * * *